US005253633A

United States Patent [19]

Sisko

[11] Patent Number: 5,253,633

[45] Date of Patent: Oct. 19, 1993

[54] ARROW STABILIZER APPARATUS

[76] Inventor: Frank W. Sisko, 159 Elkin Ave., Indiana, Pa. 15701

[21] Appl. No.: 947,475

[22] Filed: Sep. 21, 1992

[51] Int. Cl.[5] ..... F41B 5/22

[52] U.S. Cl. ..... 124/44.5; 124/24.1

[58] Field of Search ..... 124/23.1, 24.1, 25.6, 124/44.5, 86, 88, 89, 90

[56] References Cited

U.S. PATENT DOCUMENTS

| | | | |
|---|---|---|---|
| 4,282,850 | 8/1981 | Warnicke | 124/24.1 |
| 4,351,311 | 9/1982 | Phares | 124/44.5 |
| 4,917,072 | 4/1990 | Chang | 124/44.5 |
| 5,025,773 | 6/1991 | Hintze et al. | 124/44.5 |
| 5,042,450 | 8/1991 | Jacobson | 124/44.5 |
| 5,095,884 | 3/1992 | Mertens | 124/44.5 |

*Primary Examiner*—Randolph A. Reese
*Assistant Examiner*—John Ricci
*Attorney, Agent, or Firm*—George C. Atwell

[57] ABSTRACT

An arrow stabilizer apparatus for mounting to the riser of an archery bow in order to support and stabilize an arrow during the shooting process. The arrow stabilizer apparatus includes a major body member which is substantially tubular-shaped and laterally mounted to the riser of the archery bow. The major body member includes an elongated bore and a slot cut from the major body member to permit longitudinal and coaxial loading of the arrow into the bore. A retractable and insertable, spring-biased top plunger is mounted to the major body member and projects down into the bore for contacting the arrow and maintaining its longitudinal orientation during the shooting process. In addition, a pair of spaced-apart, spring-biased bottom plungers are also mounted to the major body member and project upwardly into the bore in cooperating relationship with the spring-biased top plunger for supporting and maintaining the longitudinal orientation of the arrow disposed within the bore during the shooting process. The arrow stabilizer apparatus includes several ways to adjust the major body member either transversely or laterally with respect to the bow to accommodate arrows of different lengths.

9 Claims, 2 Drawing Sheets

ARROW STABILIZER APPARATUS

BACKGROUND OF THE INVENTION

The present invention pertains to archery bows, and more particularly relates to apparatus mounted to the bow for stabilizing the arrow and improving the range, accuracy, and speed of the arrow during the shooting process.

Modern archery has become a highly skilled and specialized activity irrespective of whether one engages in the sport for pleasure or competition. Numerous refinements in the design and construction of archery bows, as well as accessories for attachment thereto, have been developed in order to enhance the range, accuracy, and speed of shot arrows.

Among the devices developed for improving archery shooting are various types of arrow support devices which are mounted at the mid-point of the bow, and are used to maintain and support the arrow's horizontal orientation during the process of loading the arrow onto or within the arrow support device, drawing the bowstring back, and then releasing the arrow at the target. The factors that must be considered in archery shooting include the type and poundage of the archery bow, the distance and position of the target, and the length and weight (measured in grains) of the particular arrow being used.

The prior art discloses a number of devices for utilization in archery shooting. Among these devices are U.S. Pat. No. 4,351,311 (Phares), which discloses an apparatus for holding a drawn arrow and then releasing the arrow after the bow is pulled back slightly beyond the position in which it is held. The Phares device includes a support secured to the bow which carries a movable arrow-holding bar. The bar includes a point-receiving indentation for receiving the arrow point.

U.S. Pat. No. 5,025,773 (Hintze, et al.) discloses an arrow rest mounted behind the bow handle and which includes a yoke mounted to the rear portion of the arrow rest. The yoke is pivotally and adjustably mounted thereto and defines an opening in which the arrow is mounted. A pair of pedestals are mounted to the yoke and extend into the opening for supporting the arrow. A resilient retaining member extends into the opening opposite the pedestals and is positioned to limit lateral movement of the arrow during rest and flight.

U.S. Pat. No. 5,042,450 (Jacobson) discloses an apparatus for supporting an arrow on an archery bow. The Jacobson patent includes three adjustable resilient finger members circumferentially adjustable on an annular frame member for supporting the arrow.

Although the above devices display ingenuity in helping the archer achieve maximum shooting proficiency, there remains a need for an arrow support device which is readily adaptable and adjustable to arrows of various lengths and weights, which facilitates accurate, long-range arrow shooting, and which is adaptable to various types of archery bows.

SUMMARY OF THE INVENTION

The present invention comprehends an apparatus for mounting to an archery bow for enhancing archery shooting. More specifically, the present invention comprehends an arrow stabilizer apparatus which is mounted to the riser of the bow generally rearwardly thereof for supporting, maintaining, and stabilizing an arrow disposed in the arrow stabilizer apparatus during the entire process of loading the arrow within the arrow stabilizer apparatus, drawing the arrow and bowstring back, and releasing the arrow at a target.

The arrow stabilizer apparatus includes a major body member which is an elongated, octagonal, substantially tubular-shaped structure that is mounted to the riser of the bow generally rearwardly thereof. The major body member of the present invention is comprised of seven continuously joined elongated flats. The flat which would comprise the eighth side is cut out to reveal an elongated slot coequal in length with the major body member (the flats are typically manufactured from aluminum, metal, or galvanized steel). The slot permits loading of the arrow into an elongated bore which is defined, and enclosed by, the major body member and which extends the full length of the major body member. The topmost, horizontally-disposed flat and the two bottom angled flats each have a plurality of spaced-apart mounting holes successively positioned along the length of the above-named flats.

Mounted to the topmost horizontal flat and projecting into the bore through one of the mounting holes is a selectively manually retractable and insertable spring-biased top plunger. The top plunger is adapted for selective insertion into the bore and retraction out of the bore. The top plunger is adapted for contacting and abutting the arrow and maintaining the horizontal and longitudinal disposition of the arrow when the arrow is loaded into the bore. In addition, the arrow can be shot when the top plunger is in the retracted position.

Opposite the top plunger and mounted to each bottom angled flat is a spring-biased bottom plunger. The bottom plungers are spaced from each other and project into the bore at an angle for cooperatively forming a cradle means for supporting the arrow. The projection of the bottom plungers into the bore is in the same vertical plane as the downward vertical projection on the top plunger. The bottom plungers are linearly adjustable so that they can fully extend into the bore or be drawn out of the bore. The bottom plungers abut and contact the arrow in cooperating relationship with the top plunger for stabilizing the arrow in a generally horizontal plane with respect to the vertical orientation of the bow to the ground during the process of loading and shooting.

Several methods of attachment and adjustment are utilized by the present invention to permit the removable mounting of the arrow stabilizer apparatus to the riser of the bow, and also to permit the selective transverse and lateral adjustment of the arrow stabilizer apparatus relative to the bow in order to accommodate arrows of different lengths and archer's varying arm lengths.

It is an objective of the present invention to provide an arrow stabilizer apparatus which allows the archer to shoot shorter arrows at high speeds, thus improving arrow range.

It is another objective of the present invention to provide an arrow stabilizer apparatus that permits the plunger member and support members to be removably mounted into mounting holes spaced along the length of the arrow stabilizer apparatus so as to accommodate and support arrows of varying lengths.

A still further objective of the present invention is to provide an arrow stabilizer apparatus which compensates for the torque that occurs when an archer pulls back on the bowstring and prevents deflection of the arrow from its flight line caused by this torque when the archer releases the bowstring and shoots the arrow.

Other objects, features, and advantages of the present invention will become apparent upon reading the following specification in conjunction with the drawings.

DETAILED DESCRIPTION OF THE PREFERRED EMBODIMENT

Figure 2:
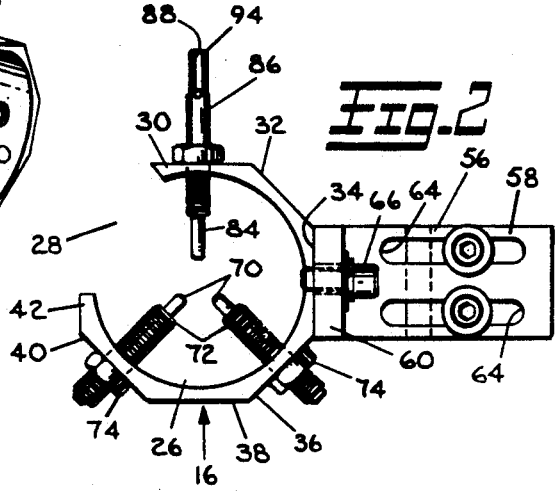
FIG. 2 is a rear elevational view of the arrow stabilizer apparatus first shown in FIG. 1.
Figure 3:
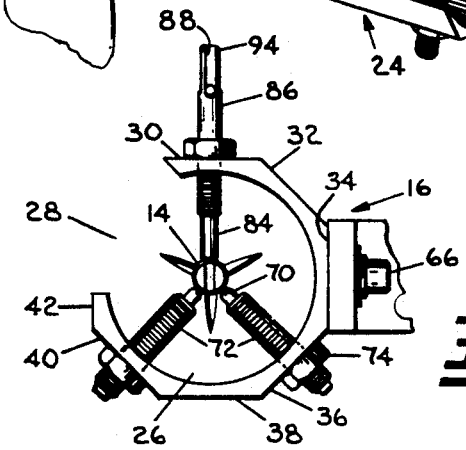
FIG. 3 is a rear elevational view of the arrow stabilizer apparatus first shown in FIG. 1 illustrating the disposition of an arrow within the bore of the major body member.
Figure 4:
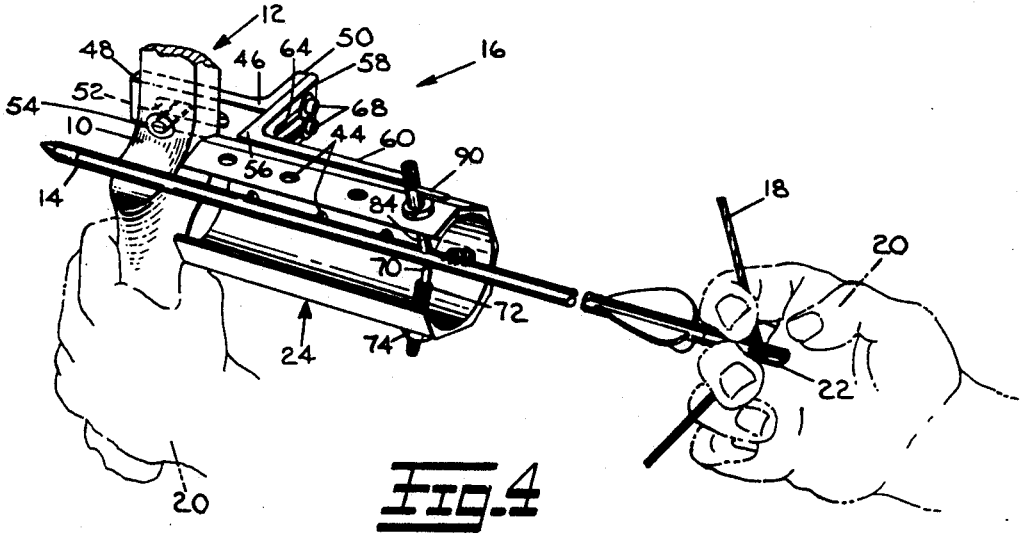
FIG. 4 is a perspective view of the arrow stabilizer apparatus first shown in FIG. 1 illustrating the disposition of the arrow within the major body member during the shooting process.

Referring to FIGS. 1-6, there is shown an apparatus for mounting to a riser 10 of an archery bow 12. Specifically, the apparatus is utilized for supporting, guiding, and maintaining the horizontal, longitudinal orientation of an arrow 14 relative to the generally vertical orientation of the bow 12 during the shooting process. The apparatus of the present invention is an arrow stabilizer apparatus 16 into which the arrow 14 is loaded or placed, as shown in FIG. 4, and is adapted for lateral mounting to the riser 10. When disposed in its operative position for shooting at a target (not shown), the bow 12 is vertically oriented generally perpendicular to the ground and the riser 10 is formed at the mid-point of the bow 12. A bowstring 18 is tautly stretched between and firmly and securely attached to either end (not shown) of the bow 12, a portion of the bowstring 18 being illustrated in FIG. 4, and the bow 12 and bowstring 18 form a vertical plane perpendicular to the ground. Poundage or draw weight is an essential element or factor to be considered in the construction of bows, and can widely vary. Archery bows can range from fifteen pounds to in excess of eighty pounds; these numbers are determined by the amount of force required to draw the bowstring 18 back to a predetermined maximum position toward the archer, represented in FIG. 4 by a pair of hands 20, one of which is holding the bow 12 and the other of which is shown drawing back the bowstring 18 and holding the arrow 14 just before a knock 22. Arrow lengths can also vary and are dictated by arm length: generally, women and children have shorter arm lengths than men. A standard arrow, as determined by the American Manufacturing Organization, has a length of thirty inches and a weight of 540 grains.

Figure 1:
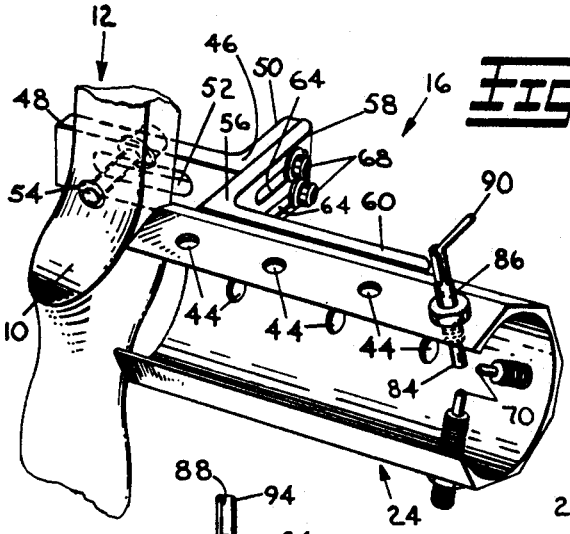
FIG. 1 is a perspective view of the arrow stabilizer apparatus of the present invention shown mounted to the riser of an archer bow.

Referring to FIGS. 1 and 4, the apparatus 16 includes a major body member 24 having an elongated, octagonal-shaped, rigid, tubular-shaped structure, the body member 24 adapted for mounting to the riser 10 by structural elements which will be more fully described hereinafter. The body member 24 is horizontally oriented relative to the bow 12 when disposed in its operative position and is mounted generally rearwardly of the bow 12; although, as shall be further described, the body member 24 can be adjusted so that it will project evenly with the portion of the bow 12 adjacent the riser 10. The body member 24 has a front end and a rear end and is preferably manufactured from aluminum by an extrusion process and then cut down to the particular size required by the archer. The body member 24 is octagonal-shaped, as shown in FIGS. 1-4 and 6, and is characterized by a plurality of elongated, flat, smooth, continuously-joined flats which enclose and define an inner elongated bore 26 which extends from the front end to the rear end of the body member 24. The bore 26 defines a central axis whose imaginary projection outward from the front end and the rear end of the body member 24 is perpendicular to the riser 10 and generally horizontal to the ground. The bore 26 further defines the passage for the arrow 14 as it is shot from the bow 12, and the bore 26 is coequal in length with the body member 24.

Although the body member 24 is octagonal-shaped, the flats do not form a continuous enclosure about the bore 26. Instead, as shown in FIGS. 1-4 and 6, the place where one upper angled flat should be is left vacant for the creation of an elongated slot 28. The slot 28 is coequal in length with the body member 24 and is adapted to permit full length passage of the arrow 14 therethrough so that the arrow 14 can be loaded and placed within the bore 26. The arrow 14 is loaded within the bore 26 in a longitudinal and coaxial disposition but, generally, the arrow 14 will be longer than the body member 24 and will project from both ends thereof. The flats can be further defined with reference to FIGS. 2, 3, and 6, labeling them in a clockwise direction as: the topmost horizontal flat 30, the left upper-angled flat 32, the left vertically-disposed flat 34, the left lower-angled flat 36, the bottommost horizontal flat 38, the right lower-angled flat 40, and the right vertical half-flat 42. The half-flat 42 is simply one flat having originally the same dimensions as the flat 34 but with half of its mass removed so as to permit easier loading for the arrow 14 through the slot 28, which is now slightly widened.

Figure 6:
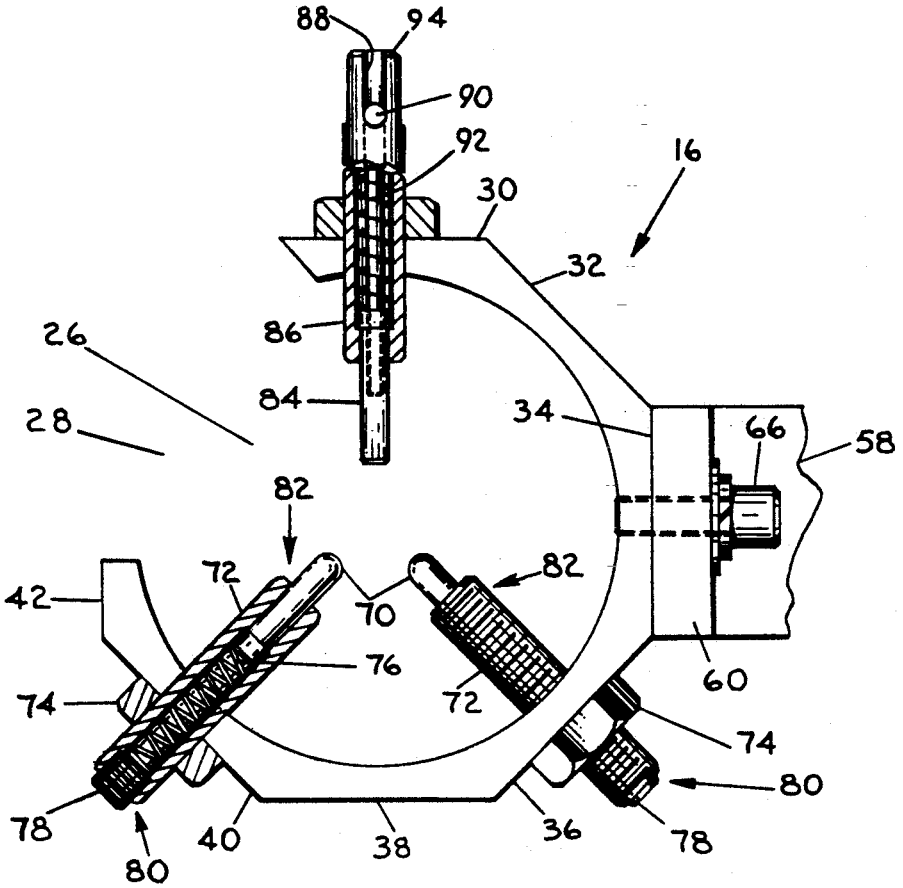
FIG. 6 is a rear elevational view of the arrow stabilizer apparatus first shown in FIG. 2 with a spring-biased top plunger and a spring-biased bottom plunger broken away to reveal internal structural components.

Referring to FIGS. 1, 4, and 6, the body member 24 includes a plurality of mounting holes successively arranged thereabout the body member 24. More specifically, the respective flats 30, 36, and 40 each have spaced-apart holes 44 located thereon and extending through each respective flat 30, 36, and 40. In addition, the holes 44 comprise a first adjustment means and are adapted to receive structural elements which will be described hereinafter. The holes 44 are arranged on each flat 30, 36, and 40 from the front end to the rear end on the body member 24 in four successive and equally spaced-apart vertical planes. However, the body member 24 can have either fewer or more mounting holes 44 located on the respective flats 30, 36, and 40 than the four holes 44 in the preferred embodiment of the present invention.

The apparatus 16 includes a second adjustment means for selectively adjusting it transverse to the riser 10 to accommodate arrows of different lengths; and the apparatus 16 further includes a third adjustment means for selective slidable adjustment to or away from the riser 10 in a direction lateral to the vertical projection of the bow 12. The aforementioned adjustment means permits maximum discrete positioning of the body member 24 relative to the riser 10.

As illustrated in FIGS. 1 and 4, the apparatus 16 includes a slidable bracket member 46 having a first mounting bracket leg 48 and a second mounting bracket leg 50, both having a generally rectangular cross-section and integrally joined at a right angle. The bracket 46 is preferably manufactured from aluminum and is adapted for selective securement to or removal from the riser 10.

Figure 5:
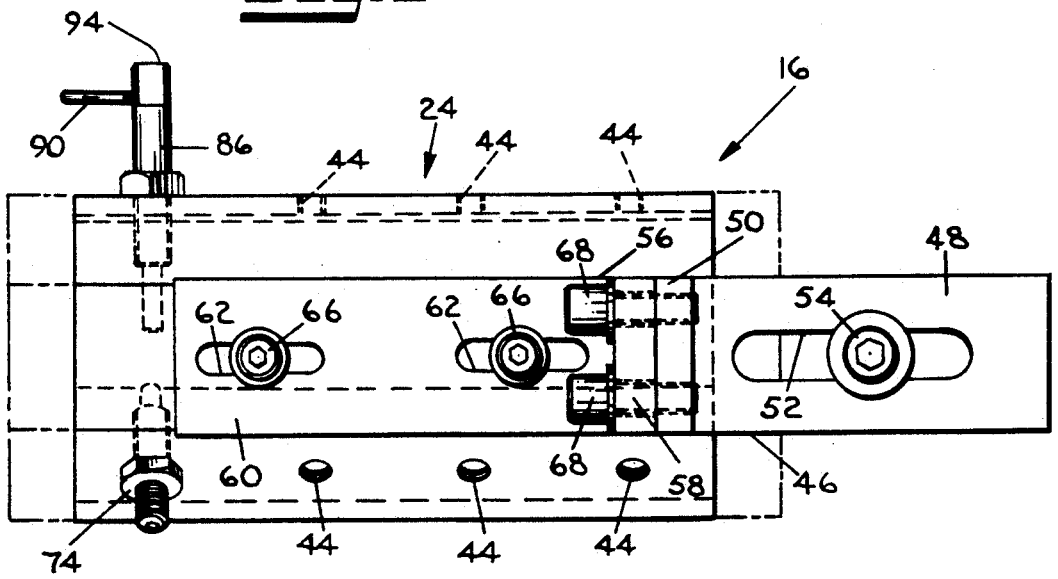
FIG. 5 is a side elevational view of the arrow stabilizer apparatus first shown in FIG. 1 illustrating the various methods for adjusting the arrow stabilizer apparatus.

As shown in FIGS. 1, 4, and 5, generally centrally located on the leg 48 and cut out and extending therethrough, is an elongated aperture 52. The riser 10 has at least one threaded receiving aperture extending therethrough, as shown in FIGS. 1 and 4, and the aperture 52 is aligned with the threaded aperture of the riser 10. A fastener 54, such as a threaded screw or bolt, is inserted into and through the aperture 52 and into the threaded aperture of the riser 10. FIG. 1 illustrates the attachment of the bracket 46 to the riser 10 from the inside portion of the riser 10; FIG. 4 shows the bracket 46 attached to the riser 10 from the outer portion of the riser 10. The leg 50, which is shorter than the leg 48, also has two spaced-apart threaded receiving holes (not shown) extending therethrough and whose purpose will be described hereinafter.

An L-shaped mounting bracket 56 is disposed in contiguous securement to the flat 34 and includes a first leg member 58 and a second leg member 60. The legs 58 and 60 are joined at a right angle as shown in FIGS. 1 and 4 and are generally of rectangular cross-section. When the bracket 56 is disposed in its operative position, the leg 58 is contiguously attached to the leg 50 and the leg 60 is contiguously attached to the flat 34. As shown in FIG. 5, the leg 60 includes a pair of horizontally-disposed, spaced-apart second leg slots 62 for allowing selective slidable movement and positioning of the body member 24 to or away from the riser 10. In addition, the leg 58 includes a pair of leg slots 64, as shown in FIGS. 1, 2, and 4, which permit the slidable lateral adjustment of the bracket 56 relative to the riser 10. Together the slots 62 and 64 comprise the third adjustment means and permit the selective, discrete positioning of the body member 24 to accommodate arrows of different lengths and archers having different arm lengths. The flat 34 has a pair of spaced-apart, horizontally-aligned through-holes extending through its surface (not shown). A pair of threaded fasteners 66, such as screws or bolts, are inserted through the slots 62 and, after the appropriate selective slidable positioning of the body member 24 relative to the riser 10 is attained, the fasteners 66 can be tightened down upon the leg 60, thus securing the body member 24 in place. As shown in FIG. 6, the fasteners 66 extend into the through-holes of the flat 34 but do not extend into the bore 26. Furthermore, a pair of fasteners 68 are adapted for selective insertion and removal into each slot 64. Each fastener 68 is inserted through each respective slot 64 and into threaded receiving holes (not shown) of the leg 50. Before the fasteners 68 are tightened down, the leg 58 can be slidably and reciprocably moved for laterally adjusting the bracket 56 relative to the riser 10. Once the correct position is achieved, the fasteners 68 can be tightened down upon the leg 58, securing the leg 58 to the leg 50. The apparatus 16 thus has three different discrete ways of positioning the body member 24 relative to the riser 10 and the bow 12. The holes 44 comprise the first adjustment means, the aperture 52 of the leg 48 which allows for selective transverse adjustment of the bracket 46 comprises the second adjustment means; and the slots 62 and 64 together comprise the third adjustment means. The length of the respective slots 62 and 64 and the aperture 52 define and limit the amount of slidable and reciprocal adjustment of the brackets 46 and 56. Longer slots 62 and 64 and a longer aperture 52 would allow for more slidable adjustment of the brackets 46 and 56 but would also structurally weaken the aforesaid brackets 46 and 56.

As shown in FIGS. 1–6, the apparatus 16 includes a stabilizing means for supporting and maintaining the longitudinal orientation of the arrow 14 when the arrow 14 is placed within the bore 26 for shooting. In order to achieve optimum shooting accuracy, ideally, the arrow 14 should maintain its longitudinal orientation with respect to the bore 26 without any deviation therefrom during its flight. The stabilizing means of the present invention includes a pair of spaced-apart, spring-biased bottom plungers 70 which are adapted for removable mounting to the body member 24. The plungers 70 are mounted within structure that is adapted for selective linear adjustment into and toward the axis of the bore 26. The plungers 70 can also be linearly adjusted away from the axis of the bore 26 and outwardly from the body member 24. As illustrated in FIGS. 2, 3, and 6, one plunger 70 is mounted to the flat 40 and protrudes into the bore 26 at an angle, and the other plunger 70 is inserted into the flat 36 and also protrudes into the inner bore 26 at an angle. As shown in FIGS. 1 and 4, both plungers 70 are located in the same vertical plane and are mounted into each respective rearmost hole 44 located on the flats 36 and 40. The plungers 70 cooperatively form a cradle means for supporting and maintaining the arrow 14 in its longitudinal and coaxial disposition within the bore 26.

As shown in FIG. 6, each plunger 70 is mounted within a bottom plunger tubing or casing 72 which is generally cylindrical-shaped, elongated, and externally threaded and is adapted for removable mounting to the holes 44 of flats 36 and 40. A jamb or lock nut 74 is threaded onto the casing 72 and tightened down against each respective flat 36 and 40 to secure and maintain the position of each respective plunger 70 and casing 72. Located inside each casing 72, as shown in FIG. 6, is a coil spring 76. Each coil spring 76 has a weight generally equal to or greater than 1.5 pounds. However, the coil spring 76 may be of less weight depending on the arrow weight. When a force is applied to each plunger 70, the plungers 70 are able to retract within the casings 72, and when the force is lessened or completely removed the plungers 70 project or spring back to their fully extended position as shown in FIG. 2. FIG. 3 shows the position of the plungers 70 when an arrow 14 is disposed within the bore 26, and FIG. 4 illustrates the plungers 70 maintaining their position and cooperatively supporting the longitudinal disposition of the arrow 14 as it is being drawn back for shooting at a target. It should be noted that the weight of the springs 76 disposed within the casings 72 for providing tension for the plungers 70 can be varied with respect to the weight of the particular arrow being used. For example, a very heavy arrow would require heavier springs for the plungers 70. Each casing 72 includes a set screw 78 threadably inserted into the external casing end 80 which is opposite the internal casing end 82 from which the plungers 70 extend or project into the bore 26. In order to change the springs 76 to a different spring weight, the screws 78 can be merely removed and the springs 76 can be easily and quickly replaced by springs of lighter or heavier weight in respect to arrows of various weights. After new coil springs are inserted into the casings 72, each screw 78 is threadably inserted into each casing 72 for closing off the casing 72 and supporting one end of the spring 76. Thus, the casings 72 are not only selectively linearly adjustable into the bore 26 or outwardly therefrom, thus facilitating the linear adjustment of the plungers 70, but the spring weights are interchangable depending on the arrow weight.

As shown in FIG. 1–6, a selectively manually retractable and insertable spring-biased top plunger 84 is mounted to the body member 24 for projecting or protruding downwardly into the bore 26 in cooperating relationship with the plungers 70 for selectively contacting the arrow 14. More specifically, the elongated plunger 84 is mounted to the flat 30 and is inserted through the rearmost hole 44 located thereon. The plunger 84 is carried or mounted within a top tubing or casing 86 which is of a cylindrical and elongated shape and substantially threaded throughout a major portion of its external surface. The casing 86 is also selectively linearly adjustable to position the plunger 84 closer in relation to the axis of the bore 26 and for withdrawing the casing 86 outwardly from the bore 26 so that the plunger 84 is away from the axis of the bore 26 when the plunger 84 is in its inserted disposition. At the portion of the casing 86 which projects out of and above the flat 30, a slot or groove 88 is cut on the unthreaded surface thereof. The plunger 84 is slidably inserted within the casing 86 with the end of the plunger 84 projecting out of the bottom of the casing 86 for selectively contacting the arrow 14 disposed within the bore 26. In addition, the casing 86 is adapted for removable mounting to any of the holes 44 on flat 30.

Illustrated in FIG. 6 is a selectively manually retractable and insertable arm 90, a portion of which projects perpendicular to the plunger 84. The arm 90 can be integrally formed form the plunger 84 or, as shown in FIG. 6, can be threadably attached to the plunger 84 by insertion into a threaded blind hole of the plunger 84. Thus, the plunger 84 and the arm 90 may be either a one-piece or a two-piece fitting. The arm 90 rides within the groove 88 as shown in FIGS. 1–6. Also disposed within the casing 86 and encompassing a major portion of the plunger 84 is a coil spring 92. The spring 92 is lighter than the springs 76 and is generally a 1.5 pound spring. The spring 92 is of a lighter load than the springs 76 and will generally stay that way as the spring 92 is not easily removable from the casing 86 due to the method of manufacture of the casing 86. In order to retract the plunger 84, the archer would simply use one finger to lift up on the arm 90 until it is pulled up to the circular external rim 94 of the casing 86. As the archer is pulling up on the arm 90, the arm 90 is riding within the groove 88. To set the plunger 84 in its retracted position the archer would simply pivot the arm 90 so that the arm 90 rests on the rim 94 as shown in FIG. 1. In its fully retracted position the plunger 84 is fully encompassed within the casing 86 as shown in FIG. 1, the spring 92 is compressed within the casing 86, and even the end of the plunger 84 does not protrude from the bottom of the casing 86. To insert the plunger 84 into the bore 26 for selectively contacting the arrow 14, the archer simply pivots the arm 90 so that it is aligned with the slot 88 and then the archer releases his finger from the arm 90. The stored energy in the contracted spring 92 is thus released and the expansion of the spring 92 propels the end of the plunger 84 through the bottom opening of the casing 86 for projection into the bore 26.

Before mounting the plunger 84 and the plungers 70 to the body member 24 by threadably inserting casings 72 and 86 into the respective holes 44, the appropriate spring weights can be chosen for all the plungers 70 and 84 depending on the weight of the arrow being used. In the apparatus 16 the plungers 70 should have substantially equal spring tension and, in addition, the spring tension of the plungers 70 would be greater than the spring tension of the plunger 84. The spring loading of the plunger 84 within the casing 86 allows for quick and efficient insertion of the arrow 14 into the bore 26 by permitting the plunger 84 to be retracted or withdrawn for loading of the arrow 14. The plungers 70 and 84 should always be mounted in the same vertical plane and, when disposed in their operative positions, they form a triangle surrounding the arrow 14 as shown in FIG. 3. The plungers 70 and 84 are adapted for selective removable mounting into any of the plurality of mounting holes 44 on the flats 30, 36, and 40.

After the body member 24 has been mounted to the riser 10 and the various adjustment means previously described have been utilized to appropriately position the body member 24 in relation to the riser 10 and the bow 12, then the arrow 14 can be loaded into the bore 26 for shooting. The archer first lifts up on the arm 90 for retracting the plunger 84 into the casing 86. Pivoting the arm 90 so that it rests upon the rim 94 holds the plunger 84 in its retracted position within the body of the casing 86. The archer can then pass the arrow 14 through the slot 28 and load it into the bore 26. The shaft of the arrow 14 rests upon and is supported and maintained in its longitudinal disposition within the bore 26 by the plungers 70. With his free hand, the archer can then pivot the arm 90 so that it is aligned with the slot 88, and then the archer can release his finger from the arm 90 thus allowing the plunger 84 to project downward into the bore 26 for contacting the arrow 14. At this point the plunger 84 and the plungers 70 are contacting the arrow 14, as shown in FIGS. 3 and 4, and, because all of the plungers 70 and 84 are spring-loaded, they forcibly and continuously contact the arrow 14 during the entire shooting process. As the arrow 14 is being drawn back for shooting at a target, the plungers 70 and 84 maintain a slidable contact therewith which permits the arrow 14 to be drawn back by the archer so that the tip thereof is encompassed by the body member 24 when the bowstring 18 is fully drawn back.

A notable feature of the apparatus 16 is that the cooperating relationship of the plungers 70 and 84 dampens excessive torque induced during the shooting process. When drawing the arrow 14 and the bowstring 18 back, the archer is actually fighting with the bowstring 18 because the bowstring 18 produces torque which is transmitted to the arrow 14 causing the arrow 14 to slightly laterally deflect or deviate from its original longitudinal disposition when initially mounted within the bore 26 on the plungers 70 and forcibly contacted by the plunger 84. The cooperating relationship of the plungers 70 and 84 aids in making the arrow 14 fly straight through the bore 26 by dampening that torque produced by the archer firmly holding and fighting with the bow 12 as the archer pulls back on the bowstring 18. Torque may also be described as arrow wobble or arrow deflection. A pin straight flight for the shot arrow 14 is what the archer hopes for in order to achieve the most consistency in shooting. When the archer releases the bowstring 18 and the arrow 14 begins its flight through the bore 26 and towards a target, the plungers 70 continuously and forcibly contact and support the arrow 14 in its travel and the plunger 84 forcibly and continuously contacts the arrow 14 thus dampening the torque induced during the shooting process.

In addition, the plunger 84 also assists in preventing the arrow 14 from being torqued off the plungers 70 during the process of actually drawing back the bowstring 18 and the arrow 14. When the archer is out hunting in the fields and forests, it is common for the excitement and nervousness of the hunter upon sighting game to have his aim thrown off or the arrow 14 jolted or moved completely off the plungers 70. When inserted into the bore 26 for forcibly and continuously contacting the arrow 14, the plunger 84 holds the arrow 14 down upon the plungers 70 and also assists in dampening the torque induced during the shooting process. In some instances, the nervousness and excitement of the hunter will cause the hunter to draw the arrow 14 back and off any bottom supports, rests, or cradles (the arrow 14 would actually be torqued off the bottom supports or cradles) and the hunter would then shoot the arrow 14 at the target even though the arrow 14 is not supported. The use of the spring-loaded and spring-biased plunger 84 avoids the problem of the arrow 14 being torqued off of the plungers 70 by projecting downwardly into the bore 26 and forcibly and continuously contacting the arrow 14 during the shooting process.

The invention has been described in terms of a preferred embodiment. It will be obvious to those skilled in the art that many changes, deletions, and additions may be made to the preferred embodiment without departing from the spirit and scope of the invention as set forth in the claims.

I claim:

1. An arrow stabilizer apparatus mounted to the riser of a bow for stabilizing arrow flight during the shooting process, comprising:

a major body member which is substantially tubular-shaped for lateral mounting to the bow, the major body member having a front end and a rear end and defining an inner elongated bore extending therethrough;

the major body member further characterized by having a slot extending the length of the major body member for loading the arrow in longitudinal and coaxial disposition within the bore;

a pair of spaced-apart spring-biased bottom plungers mounted to the major body member and projecting into the bore and cooperatively forming a cradle means for supporting and maintaining the arrow in its longitudinal disposition within the bore;

a selectively manual retractable and insertable spring-biased top plunger mounted to the major body member and projecting downwardly into the bore in cooperating relationship with the bottom plungers for selectively contacting the arrow;

the top plunger and the bottom plungers positioned in the same vertical plane and arranged to maintain slidable contact with the arrow for dampening excessive torque induced during the shooting process;

a first adjustment means including a plurality of spaced-apart mounting holes successively arranged about the major body member for allowing the selective repositioning of the top plunger and the bottom plungers in successive vertical planes along the length of the major body member; and a second adjustment means including a slidable bracket member for selectively adjusting the major body member transverse to the riser of the bow to accommodate arrows of different lengths.

2. The arrow stabilizer apparatus of claim 1 further characterized by the bottom plungers having substantially equal spring tension.

3. The arrow stabilizer apparatus of claim 1 wherein the spring tension of the bottom plungers is greater than the spring tension of the top plunger.

4. The arrow stabilizer apparatus of claim 1 wherein the slidable bracket member includes a first mounting bracket leg and a second mounting bracket leg, the slidable bracket member adapted for slidable transverse movement relative to the bow and removable securement to the riser.

5. The arrow stabilizer apparatus of claim 4 wherein the first mounting bracket leg includes an elongated aperture for permitting slidable adjustment of the slidable bracket member prior to securement to the riser.

6. The arrow stabilizer apparatus of claim 1 further comprising a third adjustment means for selective slidable adjustment of the major body member lateral to the bow.

7. The arrow stabilizer apparatus of claim 6 wherein the third adjustment means includes an L-shaped mounting bracket having a first leg member and a second leg member, the L-shaped mounting bracket adapted for contiguous securement and removal to the slidable bracket member when the major body member is disposed in its operative position.

8. The arrow stabilizer apparatus of claim 7 wherein the first leg member includes a pair of leg slots for permitting the slidable lateral adjustment of the L-shaped mounting bracket relative to the riser of the bow.

9. The arrow stabilizer apparatus of claim 7 wherein the second leg member includes a pair of horizontally disposed, spaced-apart second leg slots for allowing selective slidable movement and positioning of the major body member to or away from the riser of the bow.

* * * * *